United States Patent [19]

Feldeisen et al.

[11] Patent Number: 4,733,857

[45] Date of Patent: Mar. 29, 1988

[54] COPIER WITH SORTING FUNCTION

[75] Inventors: Ronald F. Feldeisen; Michael J. Langdon, both of Fairport; Sukumaran K. Menon, Webster, all of N.Y.

[73] Assignee: Xerox Corporation, Stamford, Conn.

[21] Appl. No.: 73,862

[22] Filed: Jul. 20, 1987

Related U.S. Application Data

[63] Continuation of Ser. No. 615,007, May 29, 1984, abandoned.

[51] Int. Cl.[4] ..... B65H 29/00

[52] U.S. Cl. ..... 271/296; 271/184; 271/186; 271/225; 271/226

[58] Field of Search ..... 271/287–291, 271/225, 226, 297, 212, 184, 186

[56] References Cited

U.S. PATENT DOCUMENTS

| | | | |
|---|---|---|---|
| 3,104,873 | 9/1963 | Benson et al. | 271/61 |
| 4,095,782 | 6/1978 | Breuers et al. | 271/297 |
| 4,473,425 | 9/1984 | Baughman | 271/225 X |

FOREIGN PATENT DOCUMENTS

| | | |
|---|---|---|
| 58-5725 | 1/1983 | Japan . |
| 56137160 | 3/1983 | Japan . |
| 7205491 | 11/1972 | Netherlands . |

OTHER PUBLICATIONS

Groenewald, H. D. et al., "Document Cornering Mechanism", IBM Technical Disclosure Bulletin, vol. 14, No. 7, Dec. 1971, p. 2179.

Xerox Corporation "914" Copier, (see attached photo FIG. 18.6 from p. 473 of the well known treatise "Xerography and Related Processes", by Dessauer and Clark, Focal Press).

*Primary Examiner*—Richard A. Schacher

[57] ABSTRACT

A copier is disclosed as having a sorter positioned on top of the copier housing for easy access to an operator. The path of movement of processed copy sheets is repeatedly folded in order to present to the operator collated copy sets or stacks for easy observation of sorting and removal. The sheets exit the copier processing station in a horizontal plane, are turned 90° while still in the plane, are transported upwardly in a vertical plane, and deposited in sorter trays toward the operator.

4 Claims, 4 Drawing Figures

COPIER WITH SORTING FUNCTION

This is a continuation of application Ser. No. 615,007, filed May 29, 1984, and now abandoned.

The present invention is directed to an arrangement of a copier and a sorting apparatus which provides the operator with a single source of copying/sorting management, and in a minimum of space. Space requirement for the sorting function can be confined solely to the space requirement for the copier.

Present day commercial copying systems which include sorters generally require relatively large floor space, the extent of space being determined by the number of sorting trays. In addition, the advent of large copiers with sorters and their associated automatic document handling apparatus has necessitated the constant movement of the operator horizontally and vertically along the confines of the copying system in order to program the system, to manipulate the document apparatus, to remove, adjust or insert sheets with respect to the sorter, while at the same time monitoring paper jam-free movement copy sheets.

The present invention avoids the foregoing disadvantages and problems by arranging the paper path for processed copy sheets so that sorting can be accomplished and managed by the operator while being positioned at a single station relative to the copier. The paper path, in effect, is folded to permit the sorting function in a minimum of space, and continuously to present to the operator the activity pursuant to the sorted copy sheets reaching final destination, while the operator is at the console for the copier.

Therefore, it is the principal object of the present invention to permit the copying of documents and the sorting of copy sets thereof in a minimum of space.

Another object of the invention is to achieve copying and sorting into copy sets and programming thereof while the operator is at a single point of management for these activities.

Other objects and advantages will become apparent after studying the following description taken in conjunction with the accompanying drawings wherein.

Figure 1:
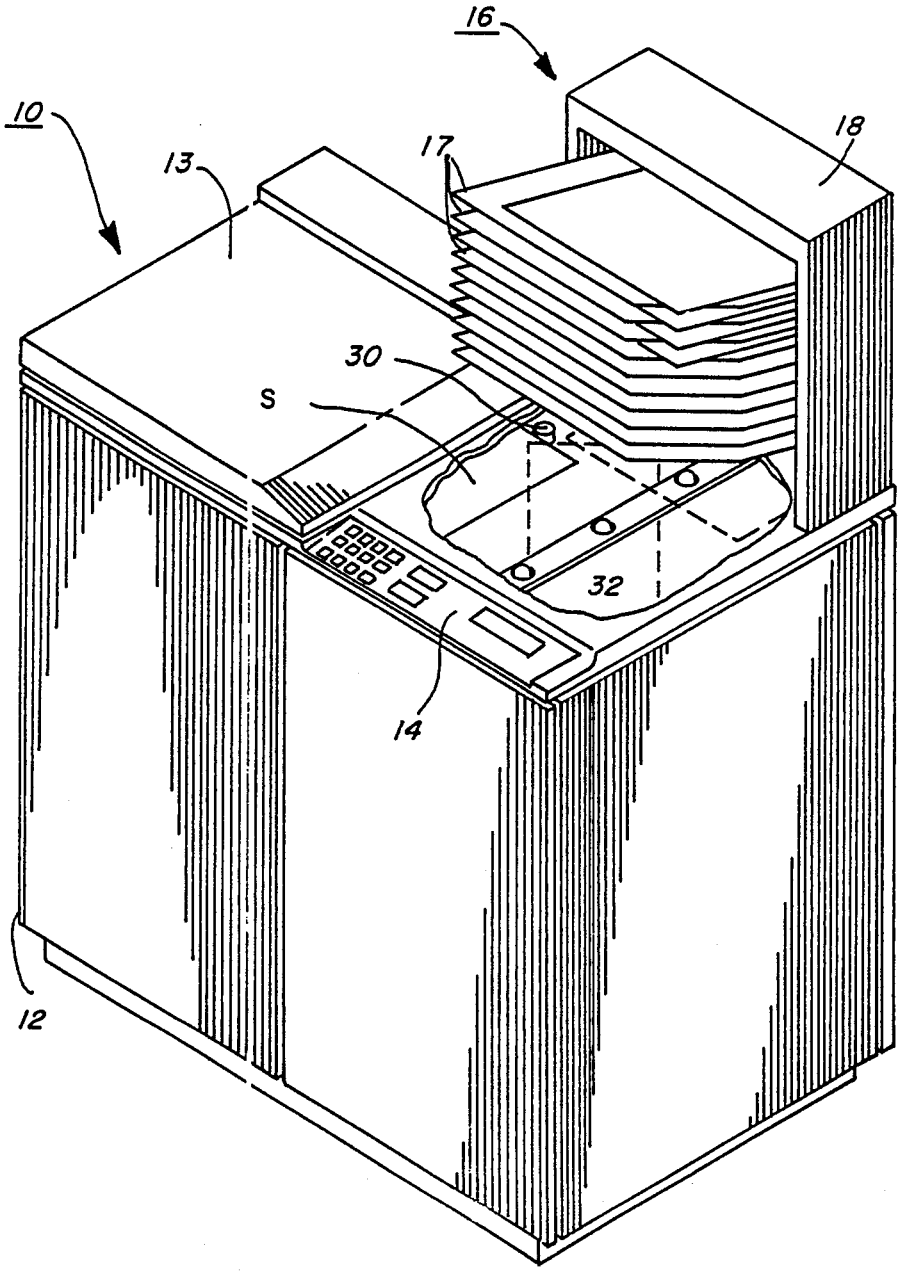
FIG. 1 is an isometric view of a copying/sorting system embodying the principles of the present invention.
Figure 2:
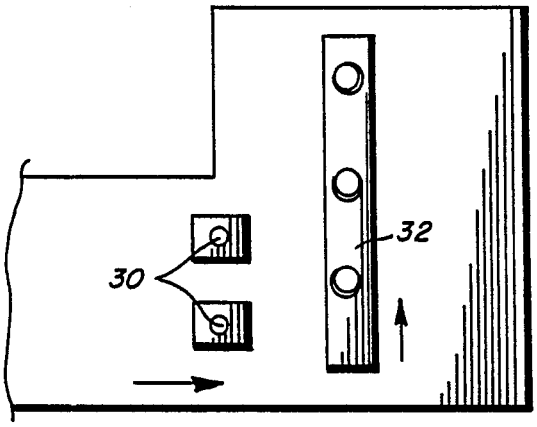
FIGS. 2 and 3 are partial schematic views of the path of movement of copy sheets between the copier and sorting apparatus utilized in the present invention.

The present invention is associated with a copier 10, preferably of the type presently in commercial use, labelled the 1075® Copier, manufactured by Xerox Corporation of Stamford, Conn. However, any other type of copier may be employed as long as copy sheets are processed and exit in edge to edge fashion instead of from top to bottom. Edge to edge processing is achieved when either of the side (or long) edges of a copy sheet, when in reading orientation, is the leading edge of the sheet as it is transported through the processor for the copier, and is exited in the same orientation.

The copier 10 includes a xerographic processor (not shown) in a housing or container 12 which serves to contain the processing stations of the copier and upon which a document handling device 13 is placed for cooperative use with the processor in the known manner. The document handling device 13 may be of the automatic or semi-automatic type, and be adapted to recirculate document sheets individually, one exposure per document sheet for each circulation of a set of document sheets, or to produce multiple exposures of each document sheet.

The system comprising the processor and the document handling apparatus 13 is under control of a programmer within the copier console section 14 which permits an operator various options: to turn the entire system ON or OFF; to program the copier for a desired number of reproductions to be made of each original document sheet or set; to select whether simplex or duplex copies are to be made; to select a desired sorted output arrangement, that is, sets mode or stacks mode; to select one of a plurality of paper trays within the copier; to condition the machine for the type of document, that is, whether one-sided or two sided; to select a copy size reduction mode, and other desirable functions. The programmer also includes a controller which provides all operational timing and synchronization between the processor and all of its xerographic processing functions, and system control functions, and the sorting events to be described hereinafter. The controller may include any suitable microprocessor having a CPU and the appropriate machine clock, and having sufficient ROM's and RAM's for all of the necessary functions in the reproduction system.

Figure 4:
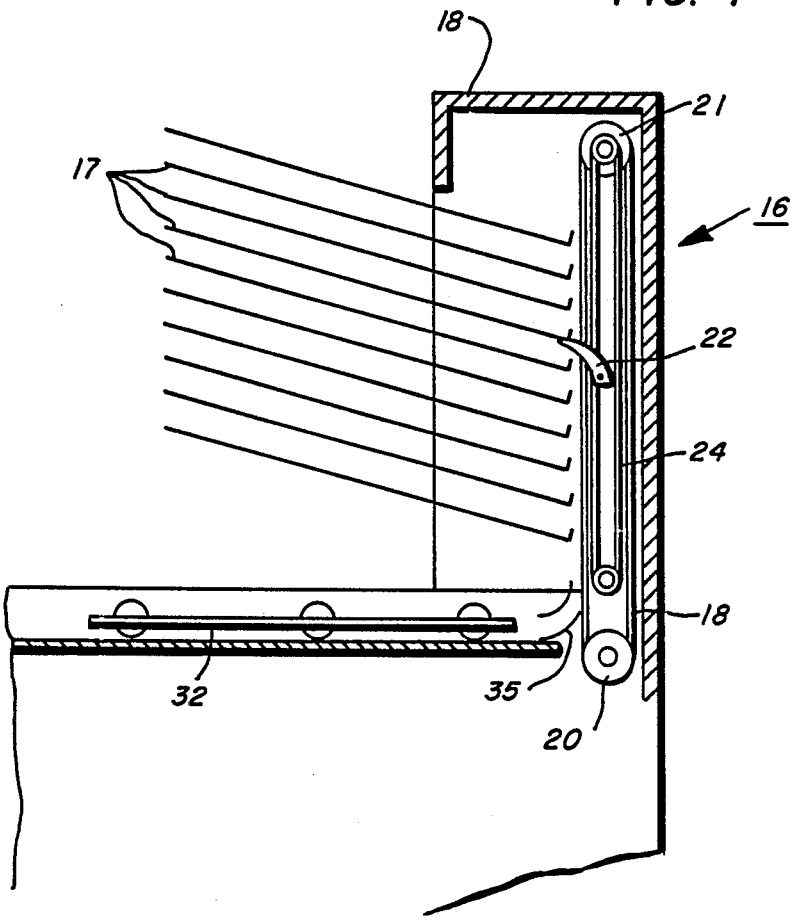
FIG. 4 is a partial schematic view of the vertical transport and a device for changing the direction of movement of copy sheets which are incorporated in the present invention.

A sorter array 16 is positioned on top of the housing 12 of the copier toward the rear end thereof and includes a plurality of copy sheet supporting trays 17 each being supported on a frame 18 in cantilever configuration with three sides thereof being opened and accessible to an operator standing before control console 14. As shown in FIGS. 1 and 4, the trays 17 extend back toward the front end of the copier directly vertically above the original horizontal plane of the path of movement of the copy sheets. Within the frame 18 are vertically arranged conveyor belts 19 entrained around spaced apart rollers 20, 21, the belts having their operating run adjacent the openings for the trays. A sheet deflecting traveling gate 22 is associated with the belts 19 for sequentially deflecting copy sheets being transported by the belts into the trays 17 starting from the bottom tray. The gate 22 is driven vertically in either direction by a belt member 24 in timed relation with the movement of the belts 19 so that as a succession of sheets are transported vertically upwardly by the belts, the gate traveling in the same direction is adapted to deflect sheets one at a time into the trays 17 in succession. Any other suitable means may be employed for directing sheets in succession, such as by an array of pivotal gates, one for each tray being positioned adjacent the opening therefor, and a solenoid for each of the gates.

Figure 3:
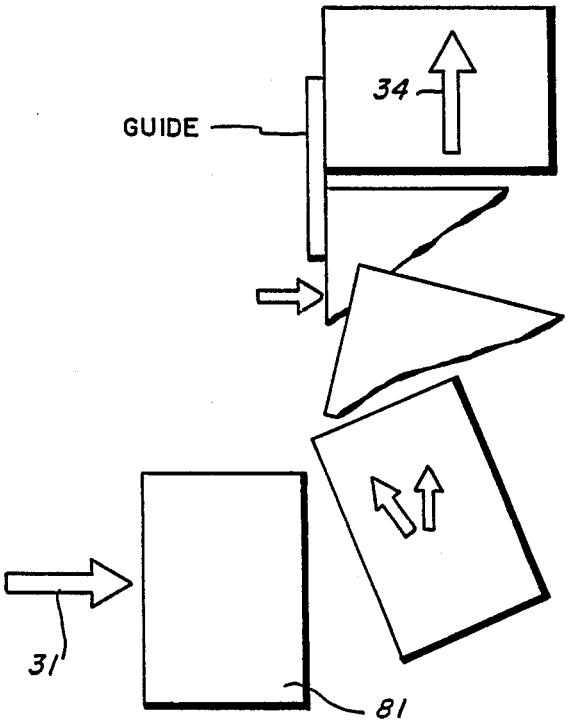

As shown in FIGS. 3 and 4, a copy sheet S, in exiting the processing stations of the copier, is oriented with its long or side edge as the leading edge and in a generally horizontal plane. A suitable transport 30 in the form of a plurality of balls on rollers transports each sheet S1 further in the direction indicated by the arrow 31. Further movement of the sheet S1 in the initial horizontal plane and direction of movement toward the side end of the copier places the leading edge thereof upon a transport 32 comprising a linear array of balls upon a belt which is arranged to convey sheets in a direction perpendicular to the initial direction of movement and toward the back end of the copier 10. The sheet then experiences two forces as the same continues to move, the forces being applied at an angle normal to one another. These forces combine to cause the sheet to turn 90° about a pivot indicted at 33 adjacent the inside corner of the sheet and, as it is driven out of the influence of the transport 30, is transported to and along a guide toward the back end of the housing 12 toward the lower section of the sorter array 16, as shown by the arrow 34.

When the leading side edge of the sheet arrives at a predetermined position below the array 16, it is guided by upwardly curved guide plates 35 into the array and upon the upwardly moving vertical transport belts 19 by final action imposed upon the sheet by the transport 32. With the sheet upon the belts 19, it is carried to the nearest tray at which the gate 22 is positioned for deflecting the sheet into that bin. As a run of copy sheets are processed, the same are likewise transported by the transports 30, 31 and into the sorter array 16 for successive collation into copy sets.

The trays 17 are arranged in cantilever fashion upon the frame 18 with their open, unsupported sides facing the operator. This permits easy removal from the sorter array by the operator while standing in the same position and attitude as was the case for programming the copies for the reproduction run in the first instance. The trays 17 are open along three sides thus presenting to the operator a full view of the collating activity, and easy and very quick access thereto in the event of malfunctioning during collation.

From the foregoing, it will be appreciated that the present invention enables a sorting/collation/stacking function to be available on top of the copier to which it is associated, thereby contributing to conserving space for this function. In addition, document manipulation, copy sheet processing, sorting and programming, are all accomplished under full management of the operator while at one position relative to the copier. In other words, a single point of management for the production of collated copy sets is accomplished. In accomplishing these goals, the present invention provides an arrangement wherein copy sheets, exiting the copy processing stations in a horizontal plane toward one side end of the copier with a long edge leading, are turned 90° and conveyed in a direction toward the rear of the copier while still in the horizontal plane. The invention further provides a second copy sheet direction changing arrangement for changing the plane of the path of movement of sheets from the horizontal plane to the vertical plane at a point adjacent the rear end of the copier. A vertically moving transport device is arranged to pick up the sheet from the second sheet direction changing arrangement and to transport the same in a vertical plane to an array of sheet sorter trays having their sheet entry openings along the vertical transport. In being deflected into and deposited onto a tray which extends toward the front end of the copier, the sheet is in a position generally vertically above the horizontal plane at which it was just prior to its entry into the array of sorter trays. This folding of the paper path for copy sheets enables a sorting/stacking function in a minimum of space and the return the copy sheets back to the close vicinity of the operator so that full control of the sheet management is always available.

While the invention has been described to the structure disclosed, it is not confined to the details set forth, but is intended to cover such modifications or changes as may come within the scope of the following claims.

We claim:

1. A copier having copy sheet processing stations arranged to produce copy sheets along a processing path with one of their long edges being the leading edge thereof, comprising:

means for orienting each copy sheet exiting from the processing horizontal plane and in a direction toward one side of the copier, first means in said path of movement for changing the direction of movement of the copy sheets approximately 90° and to transport the sheets toward the rear end of the copier while in said generally horizontal plane, second means for changing direction of movement of copy sheets from the generally horizontal plane upwardly in a generally vertical plane, a sorter having a plurality of vertically stacked sheet collecting trays positioned adjacent said rear end of the copier, and having sheet unloading portions projecting toward the front end of the copier and sheet loading openings toward the rear of the copier, and transport means arranged between said second means and said sheet openings for conveying sheets from second means to said trays during a copying/sorting run, so that said copy sheets are desirably so processed in said copier in the direction of movement of the shortest dimensions of said copy sheets, and then are rotated and transversely stacked in said sorter overlying said copier, over an area of the rear of said copier, within the perimeter of the horizontal dimensions of said copier per se, with the longest dimensions of said copy sheets extending along the rear of said copier and the shortest dimensions of said copy sheets extending partially towards the front of said copier, to provide a highly compact integral copier/sorter yet convenient front unloading of the sorted copy sheets.

2. The copier of claim 1 wherein said generally horizontal plane is positioned adjacent the top of the copier between the side ends thereof.

3. The copier of claim 1 wherein said collecting trays are positioned vertically above said generally horizontal plane.

4. A copier being defined by side ends, a rear end and a front end, and having copy sheet processing stations arranged to produce copy sheets along a processing path with one of the long edges of the sheets being the leading edge thereof, comprising:

means for orienting each copy sheet exiting from the processing stations after processing thereof to a path of movement in a direction toward one side end of the copier, means in said path of movement for changing the direction of movement of the copy sheets approximately 90° and to transport the sheets toward the rear end of the copier, means for changing direction of movement of copy sheets upwardly in a generally vertical plane, a sorter having a plurality of vertically stacked sheet collecting trays positioned adjacent said rear end of the copier, and having sheet unloading portions projecting toward the front end of the copier, and transport means for conveying sheets to said sorting trays during a copying sorting run, so that said copy sheets are desirably so processed in said copier in the direction of movement of the shortest dimensions of said copy sheets, and then are rotated and transversely stacked in said sorter overlying said copier, over an area of the rear of said copier, within the perimeter of the horizontal dimensions of said copier per se, with the longest dimensions of said copy sheets extending along the rear of said copier and the shortest dimensions of said copy sheets extending partially towards the front of said copier, to provide a highly compact integral copier/sorter yet convenient front unloading of the sorted copy sheets.

* * * * *

UNITED STATES PATENT AND TRADEMARK OFFICE

CERTIFICATE OF CORRECTION

PATENT NO. : 4,733,857

DATED : 03-29-88

INVENTOR(S) : Ronald F. Feldeisen et al.

It is certified that error appears in the above--identified patent and that said Letters Patent is hereby corrected as shown below:

Col. 4, Claim 1, line 6, insert after "processing":
--stations after processing thereof to a path of movement in a generally--

Signed and Sealed this

Twenty-seventh Day of June, 1989

*Attest:*

DONALD J. QUIGG

*Attesting Officer*

*Commissioner of Patents and Trademarks*